United States Patent [19]

Herman

[11] Patent Number: 4,550,446

[45] Date of Patent: Nov. 5, 1985

[54] INSERT TYPE FOOTWEAR

[76] Inventor: Jack Herman, 3 Prince St., Spring Valley, N.Y. 10977

[21] Appl. No.: 364,010

[22] Filed: Mar. 31, 1982

[51] Int. Cl.[4] ..... A41B 11/00

[52] U.S. Cl. ..... 2/239

[58] Field of Search ..... 2/239; 428/311, 212

[56] References Cited

U.S. PATENT DOCUMENTS

| | | | |
|---|---|---|---|
| 3,562,818 | 2/1971 | Burton | 2/239 |
| 4,341,096 | 7/1982 | Safrit et al. | 66/85 |
| 4,344,999 | 8/1982 | Gohlke | 428/212 |

OTHER PUBLICATIONS

Gore-Tex Fabric Newsletter-Fall 1980, Publication pp. 1-8, W. L. Gore & Associates Inc.

*Primary Examiner*—Doris L. Troutman

*Attorney, Agent, or Firm*—Steinberg & Raskin

[57] ABSTRACT

Footwear adapted to be inserted within a sneaker or the like, preferably between the sneaker and a conventional sock. The footwear is made of a flexible, light, waterproof material which is breathable so that although moisture cannot enter the inside thereof, vapor can pass therethrough in order to afford a high degree of comfort to the wearer. The insert type footwear is constructed from a single-piece pattern which is seamed in a manner such that none of the seams run adjacent to the sole or heel region of the foot.

7 Claims, 3 Drawing Figures

INSERT TYPE FOOTWEAR

BACKGROUND OF THE INVENTION

The present invention relates generally to articles of footwear and, more particularly, to waterproof insert type footwear adapted to be inserted within a sneaker or the like.

The sport of jogging has attained phenomenal popularity over the past few years. Participants in the sport of jogging have been known to run outdoors during even the most inclement weather including rain and snow. Accordingly, it is not uncommon for the sneakers worn by joggers to be saturated with water while the jogger is running and for his feet to become cold and wet. Of course, this is undesirable from both a comfort and health standpoint.

Moreover, since a jogger's feet will tend to perspire a great deal, especially over long runs, it is desirable for the footwear worn by the jogger to allow perspiration to be removed therefrom and not accumulate therewithin.

It is known in the prior art to provide a shoe insert constituted of a waterproof material which prevents moisture from entering the inside thereof. Thus, U.S. Pat. No. 2,293,714 discloses such a shoe insert which is adapted to be worn in lieu of the usual sock which is constructed of an interlining formed of a waterproof material such as an expandable cellular rubber, and inner lining of a perspiration absorbing material, such as flannel and an outer lining formed of suitable cloth or knit material. However, a shoe insert of the type disclosed in this patent would be unsatisfactory for use in jogging and would not overcome the problems discussed above in that the laminated material of which it is constructed is necessarily relatively heavy and inflexible, certainly not having the flexibility required for use in connection with jogging. Moreover, the expanded cellular rubber is provided in sections which are joined together by vulcanizing strips, at least one of which extends about the heel region of the insert. The presence of such a vulcanizing strip would necessarily create a degree of discomfort for the jogger since the strip would exert a pressure against the heel region of the foot as the runner jogs. Such pressure will seriously detract from the jogger's performance especially during long runs. Furthermore, the shoe insert disclosed in U.S. Pat. No. 2,293,714, is not "breathable". Thus, the presence of the waterproof interlining prevents the passage of water vapor from within the inside thereof. Thus, although a perspiration-absorbing material is provided in the form of the inner lining, once that inner lining becomes saturated with perspiration, further perspiration cannot be absorbed and will be captured within the insert. Of course, this is not tolerable in the case of joggers whose feet will perspire a great deal over long runs.

SUMMARY OF THE INVENTION

Accordingly, one object of the present invention is to provide new and improved footwear of the insert type that fits within a sneaker or the like.

Another object of the present invention is to provide new and improved insert type footwear that prevents moisture from entering into the interior thereof and which is breathable to prevent the accumulation of perspiration.

Still another object of the present invention is to provide new and improved insert type footwear that is extremely light and flexible so as to be especially suitable for use by joggers.

Yet another object of the present invention is to provide new and improved insert type footwear wherein no seams or seals are located in the sole or heel regions of the foot.

Briefly, in accordance with the present invention, these and other objects are attained by providing insert type footwear formed of a flexible light waterproof material, such as a lightweight fabric to which a Gore-Tex (trademark of W. L. Gore & Associates, Inc.) membrane is laminated. The pores of such material are many times smaller than a drop of water which makes it waterproof, but are many times larger than a molecule of water vapor which allows the material to "breathe". The footwear is constituted from a single-piece pattern which has a configuration whereby when seamed in a waterproof manner to form the footwear, none of the seams run adjacent to the sole or heel region of the foot.

DESCRIPTION OF THE DRAWINGS

A more complete appreciation of the present invention and many of the attendant advantages thereof will be readily appreciated as the same becomes better understood with reference to the following detailed description considered in connection with the accompanying drawings in which.

DESCRIPTION OF THE PREFERRED EMBODIMENTS

Figures 1, 2, 3:
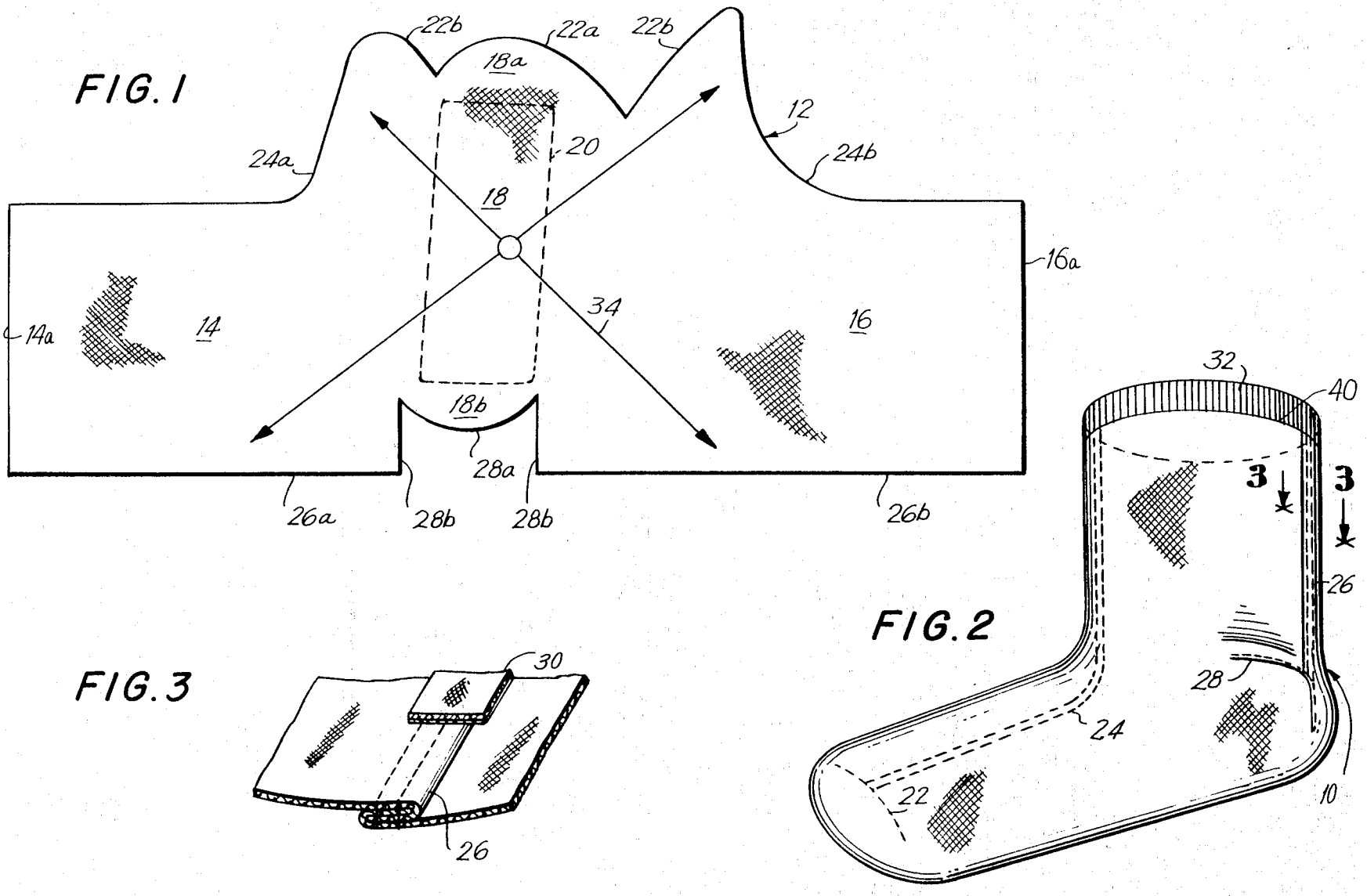
FIG. 1 is a plan view of the material for the insert type footwear of the present invention which has been cut in a preferred pattern for its construction.
FIG. 2 is a perspective view of a preferred embodiment of insert type footwear according to the present invention constructed from the pattern illustrated in FIG. 1.
FIG. 3 is a section view taken along line 3—3 of FIG. 2 and illustrating a waterproof seam used in construction of the insert type footwear of the present invention.

Referring to the drawings wherein like reference characters designate identical or corresponding parts throughout the several views, and more particularly to FIGS. 1 and 2, the insert type footwear of the present invention, generally designated 10, is constructed of a flexible, light material which is both waterproof and "breathable" i.e., allow passage of water vapor therethrough yet which will prevent passage of liquid therethrough. For example, a lightweight fabric may be utilized to which a Gore-Tex (trademark of W. L. Gore & Associates, Inc.) membrane is laminated. A Gore-Tex membrane is a microporous membrane of pure polytetrafluoroethylene (PTFE) containing more than nine billion pores per square inch. Each pore is 20,000 times smaller a drop of water which makes the fabric to which it is laminated waterproof but 700 times larger than a molecule of water vapor thereby allowing water vapor which evaporates from the body to pass through the fabric-membrane laminate. The material is cut in a single-piece pattern 12 (FIG. 1) which has a configuration such that when seamed in a waterproof manner to form the footwear 10, none of the seams run adjacent to the sole or heel region of the foot.

Referring to FIG. 1, the pattern 12 of the so-called Gore-Tex material is a unitary piece of material constituted by a pair of side regions 14, 16, and a central region 18. The central region 18 has an area which extends at its peripheral edge regions beyond an area designated by dotted line 20, which area will be situated adjacent to the sole and heel regions in the finished footwear article. Thus, it is seen that the forward and rearward peripheral edge regions **18*b* and 18*b* extend substantially beyond the border 20** of the sole and heel regions of the foot. This configuration allows the pattern to be folded and seamed such that no seams will run adjacent to the sole or heel region of the foot.

As seen in FIG. 1, the side regions 14 and 16 of pattern 12 extend a substantial distance laterally from the central region 18 and terminate at edges **14*a* and 16*a* which, when the footwear is formed from the pattern, constitutes the upper edge 40 of the footwear. When the footwear is worn, the side regions 14 and 16 extend higher than the ankle region of the foot so that the upper edge 40** of the footwear is located above the ankle region.

The insert type footwear 10 as seen in FIG. 1 is formed with only four seams, namely, seams 22, 24, 26 and 28, none of which is in the region bounded by line 20, defining the sole and heel regions of the foot. The seam 22 is formed by folding the forward peripheral edge region **18*a* of central region 18 upwardly and seaming its edge 22*a* to the the edges 22*b* of side regions 14, 16. The seam 24 is formed by seaming edges 24*a* and 24*b* of the side regions 14 and 16 to each other. The seam 26 is formed by seaming edges 26*a* and 26*b* of the side regions 14 and 16 to each other. Finally, the seam 28 is formed by folding rearward peripheral edge region 18*b* of central region 18 upwardly and seaming its edge 28*a* to the edges 28*b* of the side regions 14, 16. It is again noted that none of the seams are located in the area bounded by line 20** defining the sole and heel regions of the foot.

The seams are formed in a waterproof manner so that it is not possible for moisture to enter within the footwear 10 therethrough. In this connection a waterproof tape 30 comprising a laminated fabric, Gore-Tex membrane, and a hot melt adhesive, may be welded to the inside of a sewed seam as seen in FIG. 3 with heat and pressure provided by a hot air sewing machine such as is available from Pfaff of West Germany or from W. L. Gore & Associates, Inc. Alternatively, a seam sealer substance may be used to waterproof the seams, although the former method is preferred.

Moreover, the pattern 12 is preferably cut with the bias of the material extending in the directions shown by arrows 34. In this manner, the insert will have suitablestretchable properties. Additionally, it will be understood that the pattern 12 will be used for forming inserts for both left and right feet, it only being necessary to reverse the pattern to form the respective right and left foot inserts.

As seen in FIG. 2, an elastic collar 32 may be stitched onto the upper edge 40 of the footwear 10 to hug the leg of the wearer preferably at a location somewhat above the ankle region, to prevent the footwear from falling down when used.

The insert type footwear 10 as described above is highly advantageous in that it is light, flexible, waterproof, breathable, and presents no seams in the sole or heel region of the foot. When formed of a material such as nylon to which a Gore-Tex membrane is laminated, the footwear will weigh on the order of about one ounce which a jogger will not even feel as he runs. The footwear can be stored in a compressed or crumpled fashion with other jogging equipment so that when not used, it will not be difficult to carry or store.

Obviously, numerous modifications and variations of the present invention are possible in the light of the above teachings. For example, the insert type footwear of the present invention can be used as an insert for a boot or shoe and is not limited to jogging applications. Accordingly, the invention may be practiced otherwise than as specifically disclosed herein.

What is claimed is:

1. A sock-type article adapted to be worn on the foot and having sole and heel regions adjacent to the sole and heel regions of a foot when worn, said sock-type article being substantially entirely formed of a lightweight, flexible material defining an interior space receivable of a foot, said material being substantially waterproof to prevent passage of water into said interior of the sock-type article through said material and at the same time moisture vapor permeable to allow passage of evaporated perspiration which may be formed on the foot from said interior of the sock-type article through said material, whereby the foot will be maintained as dry as possible when the sock-type article is worn thereon.

2. The combination of claim 1 wherein the sock-type article is constructed from said material having edges which are joined to each other by seams which are waterproof to prevent passage of water into said interior of the sock-type article through said seams, and wherein none of said seams exist in said sole and heel regions of the sock-type article.

3. The combination of claim 2 wherein the sock-type article is constructed from a one-piece pattern of said waterproof and vapor permeable material.

4. The combination of claim 3 wherein said one-piece pattern includes a central region and a pair of side regions, said central region having rearward and forward peripheral edge regions which extend beyond said sole and heel regions of the sock-type article, and wherein a plurality of seams exist, none of which exist in said sole and heel regions of the sock-type article.

5. A sock-type article adapted to be worn on the foot within shoe-type apparel, comprising an article formed of lightweight flexible material which is waterproof to prevent moisture from entering into the interior thereof through said material, and which is breathable to allow water vapor to pass out from the interior thereof through said material, said article being formed from a one-piece pattern of said material whose edges are joined to each other at at least four seams of which none run adjacent to the sole or heel regions of the foot, and wherein said pattern includes a central region and a pair of side regions, said central region having rearward and forward peripheral edge regions which extend beyond the area to be contiguous to the sole and heel regions of the foot.

6. The combination of claim 3 wherein said side regions of said one-piece pattern extend a substantial distance laterally from the central region and terminate at edges which constitute the upper edge of the article when the latter is formed, which upper edge is located above the ankle region of a foot when worn.

7. The combination of claim 5 wherein said side regions of said one-piece pattern extend a substantial distance laterally from the central region and terminate at edges which constitute the upper edge of the article when the latter is formed, which upper edge is located above the ankle region of a foot when worn.

* * * * *